US010240322B2

(12) United States Patent
Miller et al.

(10) Patent No.: US 10,240,322 B2
(45) Date of Patent: Mar. 26, 2019

(54) ENERGY STORAGE SYSTEM

(71) Applicant: Caterpillar Global Mining LLC, South Milwaukee, WI (US)

(72) Inventors: Peter James Miller, Brookfield, WI (US); Arthur Milkowski, Menomonee Falls, WI (US)

(73) Assignee: Caterpillar Global Mining LLC, Tucson, AZ (US)

( * ) Notice: Subject to any disclaimer, the term of this patent is extended or adjusted under 35 U.S.C. 154(b) by 9 days.

(21) Appl. No.: 15/499,978

(22) Filed: Apr. 28, 2017

(65) Prior Publication Data

US 2018/0313060 A1 Nov. 1, 2018

(51) Int. Cl.

| | |
|---|---|
| ***G06F 7/70*** | (2006.01) |
| ***E02F 9/20*** | (2006.01) |
| ***E02F 9/22*** | (2006.01) |
| *E02F 3/32* | (2006.01) |

(52) U.S. Cl.

CPC ..... *E02F 9/2091* (2013.01); *E02F 9/2075* (2013.01); *E02F 9/2246* (2013.01); *E02F 3/32* (2013.01); *E02F 9/2095* (2013.01)

(58) Field of Classification Search

CPC ..... E02F 9/2091; E02F 9/0866; E02F 9/2095; E02F 3/0401; E02F 9/16

USPC ..... 701/50, 22; 414/694; 180/64.245; 461/490

See application file for complete search history.

(56) References Cited

U.S. PATENT DOCUMENTS

| | | | | |
|---|---|---|---|---|
| 7,137,344 | B2 * | 11/2006 | Kumar | B60K 6/46 105/35 |
| 7,658,250 | B2 * | 2/2010 | Betz | B60K 6/12 180/65.31 |
| 8,606,451 | B2 * | 12/2013 | Abdel-Baqi | E02F 9/0808 701/22 |
| 2012/0130576 | A1 * | 5/2012 | Sugiyama | B60K 6/12 701/22 |
| 2014/0244082 | A1 * | 8/2014 | Caron | B60L 11/005 701/22 |
| 2016/0002887 | A1 * | 1/2016 | Izumi | H02P 6/08 701/50 |

(Continued)

FOREIGN PATENT DOCUMENTS

DE 102012201141 8/2013

*Primary Examiner* — Shardul D Patel

(74) *Attorney, Agent, or Firm* — Bookoff McAndrews

(57) ABSTRACT

An energy storage system associated with a machine having a work tool and one or more auxiliary loads includes a power source which generates mechanical power. An energy storage device supplies power to the one or more auxiliary loads. An electrical generator is operably coupled to the power source and converts at least a portion of the mechanical power into electrical power. The electrical generator supplies the electrical power to the energy storage device. A controller is communicably coupled to the power source, the work tool, the energy storage device, and the electrical generator. The controller determines a power demand of the work tool. The controller then compares whether the determined power demand exceeds a pre-determined threshold power. The controller disables the electrical generator from supplying the electrical power to the energy storage device if the power demand exceeds the pre-determined threshold power.

20 Claims, 4 Drawing Sheets

(56) References Cited

U.S. PATENT DOCUMENTS

2016/0031328 A1* 2/2016 Lindsey ..... B60L 11/08
307/10.1
2017/0335547 A1* 11/2017 Wu ..... E02F 9/2246

* cited by examiner

ENERGY STORAGE SYSTEM

TECHNICAL FIELD

The present disclosure relates generally to energy management and storage systems. More specifically, the present disclosure relates to energy storage systems for operation with heavy equipment for mining, excavating, and construction etc.

BACKGROUND

Machines, such as power shovels and excavators, may include a deck or other platform that rotates above continuous tracks, wheels, pontoons, etc. Extending from the deck, the machine may further include a boom for an articulated arm or crane designed to operate a bucket, a breaker, a hook, or any other such work tool. Accordingly, such machines typically include one or more actuators designed to move the tracks, rotate the deck, and operate the articulated arm and work tool.

Above machines are designed to operate in substantially-repetitive work cycles. By way of example, a power shovel or excavator may typically operate in work cycles which may include digging, lifting, swinging, dumping, and returning steps for operating a bucket to dig and load fragmented rock, earth, minerals, overburden, and the like for mining purposes. Powering these operations are mechanical or electro-mechanical power systems designed for supplying power for a combined maximum power demand of the work tool and some auxiliary loads, including cooling loads etc. of the machine. Most of the time the machine underutilizes the available power due to non-uniform peak power demand based on repetitive nature of work cycles. Thus, the machine operates with an engine that is oversized for majority of its power demand profile. The oversized engine affects initial purchasing cost, operating and repairing costs, and overall life of the machine.

U.S. Pat. No. 8,606,451 (hereinafter referred to as '451 reference) describes an energy system for heavy equipment where the energy system changes the power output of the engine based upon a change in electrical demand. The '451 reference includes a method for providing electrical power to a bus for powering an actuator, providing electrical power to the bus from an energy storage device in response to an increased electrical demand on the bus, and increasing power output of the engine at a rate less than the maximum capability of the engine. However, the '451 reference does not disclose details about any solution for reduction in the engine size.

Therefore, an improved energy storage system for the machine is required.

SUMMARY

In an aspect of the present disclosure, an energy storage system associated with a machine is provided. The machine includes a work tool and one or more auxiliary loads. The energy storage system includes a power source generating mechanical power, an energy storage device, an electrical generator operably coupled to the power source, and a controller communicably coupled to the power source, the work tool, the energy storage device, and the electrical generator. The electrical generator converts at least a portion of the mechanical power into electrical power and supplies the electrical power to the energy storage device. The energy storage device supplies the electrical power to the one or more auxiliary loads. The controller determines a power demand of the work tool. The controller then compares whether the determined power demand exceeds a pre-determined threshold power. The controller disables the electrical generator from supplying the electrical power to the energy storage device, if the power demand exceeds the pre-determined threshold power.

In another aspect of the present disclosure, an energy storage system associated with a machine is provided. The machine includes a work tool and one or more auxiliary loads. The energy storage system includes a power source generating mechanical power, an electrical generator operably coupled to the power source, an energy storage device electrically coupled to the electrical generator, and a controller communicably coupled to the power source, the work tool, the energy storage device, and the electrical generator. The electrical generator converts at least a portion of the mechanical power into electrical power. The energy storage device receives the electrical power from the electrical generator. The energy storage device further supplies the electrical power to the one or more auxiliary loads. The controller determines a power demand of the work tool. The controller further determines whether the determined power demand exceeds a pre-determined threshold power. The controller then regulates the supply of the electrical power to the auxiliary loads to prolong the use of stored energy based on a characteristic property of the auxiliary loads, if the determined power demand exceeds the pre-determined threshold power.

In yet another aspect of the present disclosure, an energy storage system associated with a machine is provided. The machine includes a work tool and one or more auxiliary loads. The energy storage system includes a power source generating mechanical power, an energy storage device supplying electrical power to the one or more auxiliary loads, an electrical generator operably coupled to the power source, and a controller communicably coupled to the power source, the work tool, the energy storage device, and the electrical generator. The electrical generator converts at least a portion of the mechanical power into electrical power and supplies the electrical power to the energy storage device. The controller determines a power demand of the work tool. The controller further determines whether the determined power demand exceeds a pre-determined threshold power. The controller disables the electrical generator from supplying the electrical power to the energy storage device, if the power demand exceeds the pre-determined threshold power. The controller then regulates the supply of the electrical power to the auxiliary loads to prolong the use of stored energy based on a characteristic property of the auxiliary loads.

DETAILED DESCRIPTION

Wherever possible, the same reference numbers will be used throughout the drawings to refer to same or like parts.

Figure 1:
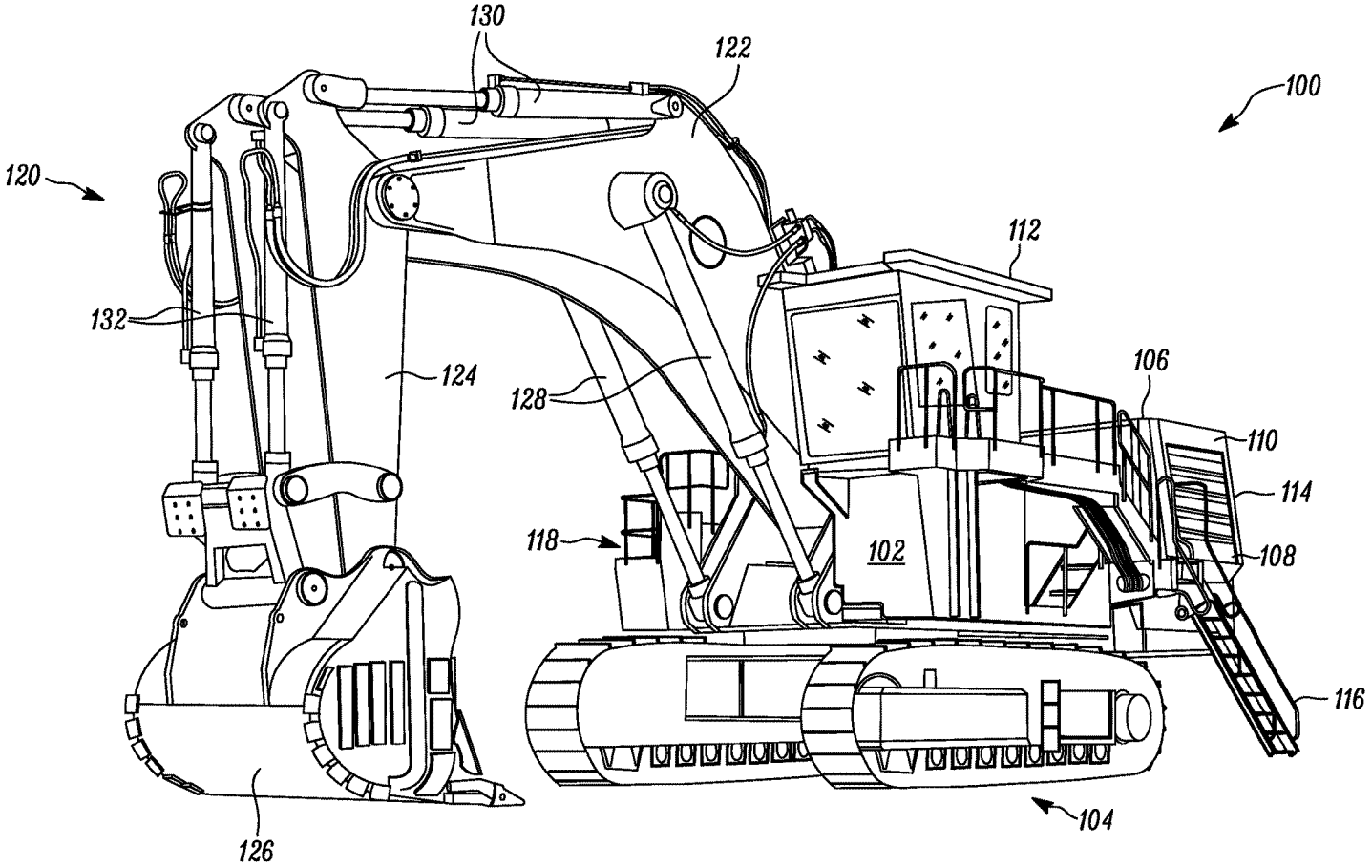
FIG. 1 is a perspective view of an exemplary machine, in accordance with an embodiment of the present disclosure.

FIG. 1 shows an exemplary machine 100. The machine 100 is illustrated as a hydraulic shovel which may be used, for example, for mining and other allied industries. While the following detailed description describes an exemplary aspect in connection with the hydraulic shovel, it should be appreciated that the description applies equally to the use of the present disclosure in other machines as well.

The machine 100 includes an upper swiveling body 102 supported on a ground engaging element 104. Although, the ground engaging element 104 is illustrated as continuous tracks, it should be contemplated that the ground engaging element 104 may be any other type of ground engaging element as well, for example, wheels etc. The upper swiveling body 102 includes a power compartment 106, a storage compartment 108, a hydraulic compartment 110, an operator cabin 112, and a cooling compartment 114. Various stairwells 116 and walkways 118 may be incorporated with the upper swiveling body 102 for movement of an operator throughout the machine 100 to access various components as per application requirements.

The machine 100 includes a work tool 120 having a boom 122 operably coupled to an arm 124 for operating a bucket 126. According to an exemplary embodiment, a pair of boom cylinders 128 extends between the upper swiveling body 102 and the boom 122 to control movement of the boom 122 relative to the upper swiveling body 102. Similarly, a pair of arm cylinders 130 extends between the boom 122 and the arm 124 to control movement of the arm 124 relative to the boom 122. Further, a pair of curl cylinders 132 extends between the boom 122 and the bucket 126 to control movement of the bucket 126 relative to the arm 124. According to an exemplary embodiment, the hydraulic cylinders 128, 130, 132 may be double-acting cylinders, configured to receive hydraulic fluid on both ends of the respective piston. Additional actuators (e.g., electric or hydraulic motors) may be used to propel the machine 100 via the ground engaging element 104, and/or to rotate the upper swiveling body 102 relative to the ground engaging element 104.

Figure 2:
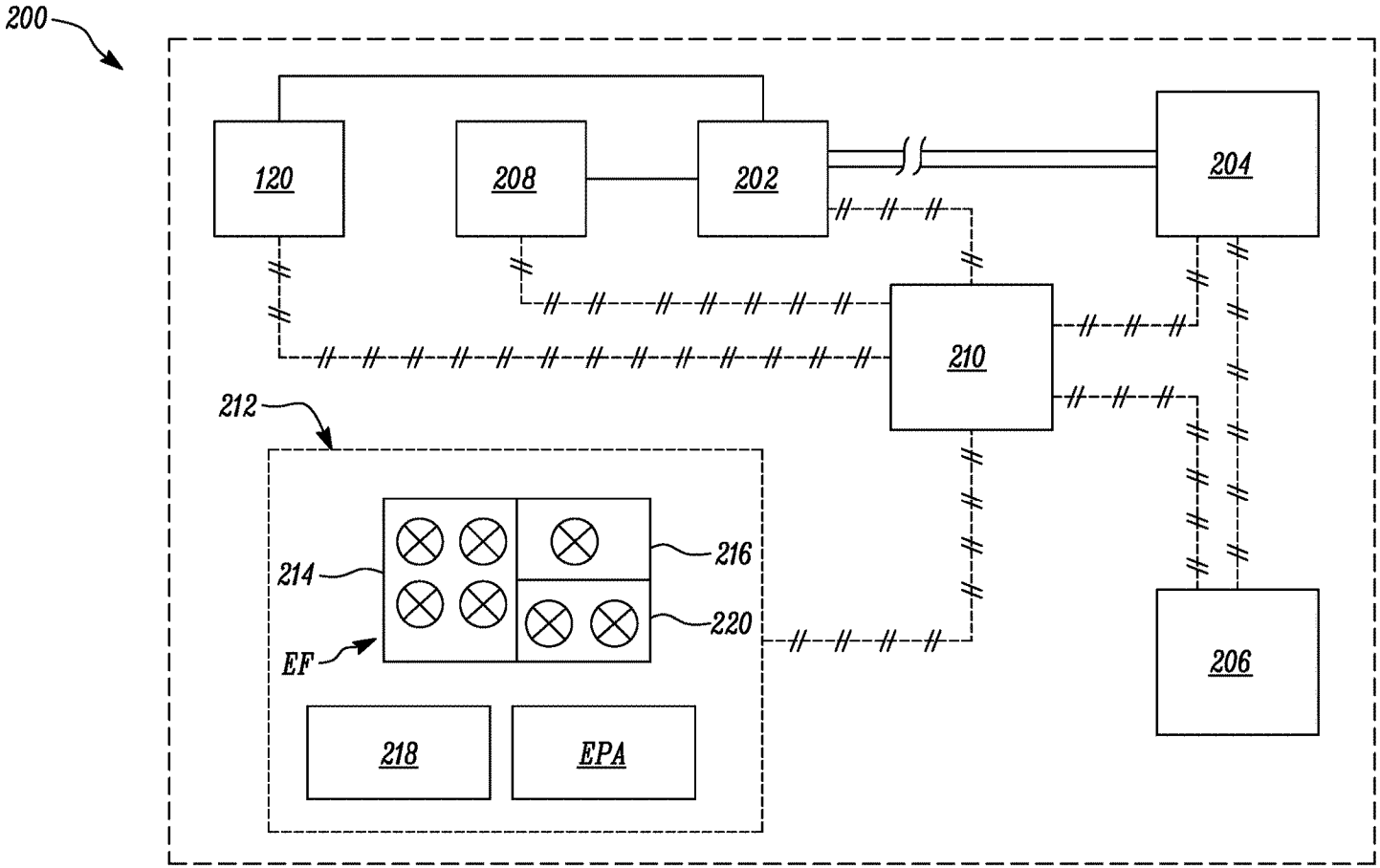
FIG. 2 is a schematic representation of an energy storage system of the machine, in accordance with an embodiment of the present disclosure.

Referring to FIG. 2, an energy storage system 200 is illustrated. The energy storage system 200 includes the work tool 120. The work tool 120 may be any implement capable of performing a task as per operator's command. In an embodiment, the work tool 120 is powered by a power source 202 placed within the power compartment 106. In some embodiments, the power source 202 may include one or more internal combustion engines (not shown) generating the mechanical power based upon fuel efficiencies, or peak power demands, etc. In some embodiments, the one or more internal combustion engines may operate one at a time or simultaneously, based upon power demand during various work cycles of the machine 100.

The energy storage system 200 further includes an electrical generator 204 operably coupled to the power source 202. The electrical generator 204 converts at least a portion of the generated mechanical power into electrical power. In an embodiment, the electrical generator 204 may be a single phase or a poly-phase generator, an alternating current or a direct current based generator, or any other type of generator which may be suitable as per the need of the present disclosure. The electrical generator 204 supplies the electrical power to an energy storage device 206 placed within the storage compartment 108. In an embodiment, the energy storage device 206 may include banks of one or more ultra-capacitors (not shown). In other contemplated embodiments, other forms of energy storage devices (e.g., secondary batteries) or other arrangements of energy storage devices may be used.

The energy storage device 206 may be electrically coupled to the electrical generator 204 for receiving the electrical power. The electrical coupling between the electrical generator 204 and the energy storage device 206 may be disabled at times to stop the supply of the electrical power from the electrical generator 204 to the energy storage device 206. It should be contemplated that various manners of enabling or disabling the supply of the electrical power may not affect the scope of the present disclosure.

A hydraulic system 208 is placed within the hydraulic compartment 110 for powering the work tool 120. In an embodiment, the hydraulic system 208 may receive mechanical power from the power source 202 for driving hydraulic pumps (not shown). In another embodiment, the hydraulic pumps may be driven by electric drives (not shown) powered by the electrical power from the energy storage device 206. In some embodiments, the hydraulic system 208 may be provided as a combination of mechanically and electrically driven hydraulic systems.

The energy storage device 206 supplies the electrical power to the one or more auxiliary loads 212. In an exemplary embodiment, the one or more auxiliary loads 212 may include electrically-powered accessories (EPA) of the machine 100. In some embodiments, the EPA may include any implements or actuators or blowers or similar accessories being powered by the electrical power stored in the energy storage device 206. Traditionally powered accessories which are driven by belt drives or such other conventional driving means may be also converted into the EPA by replacing the belt drive using electric drives.

The one or more auxiliary loads 212 include at least one of an engine cooling load 214, an operator cabin cooling load 216, a hydraulic pilot pump load 218, and a hydraulic oil cooling load 220. In an embodiment, the engine cooling load 214, the operator cabin cooling load 216, and the hydraulic oil cooling load 220 may be placed within the cooling compartment 114. In the illustrated embodiment, the engine cooling load 214, the operator cabin cooling load 216 and the hydraulic oil cooling load 220 include one or more electric fans EF arranged in a matrix arrangement for providing cooling to the coolant (not shown). The one or more electric fans EF are operably coupled to a controller 210 and may operate at variable speeds.

With continued reference to FIG. 2, the energy storage system further includes the controller 210. The controller 210 is communicably coupled to the power source 202, the work tool 120, the electrical generator 204, the energy storage device 206, and the one or more auxiliary loads 212. The controller 210 may be a single controller or multiple controllers working together to perform a variety of tasks. The controller 210 may embody a single or multiple microprocessors, field programmable gate arrays (FPGAs), digital signal processors (DSPs), etc., that include a means for regulating the supply of electrical power to the energy storage device 206 in response to operator requests, built-in constraints, sensed operational parameters, and/or communicated instructions from an off-board controller (not shown). Numerous commercially available microprocessors can be configured to perform the functions of the controller 210. Various known circuits may be associated with the controller 210, including power supply circuitry, signal-conditioning circuitry, actuator driver circuitry (i.e., circuitry powering solenoids, motors, or piezo actuators), and communication circuitry.

Figure 3:
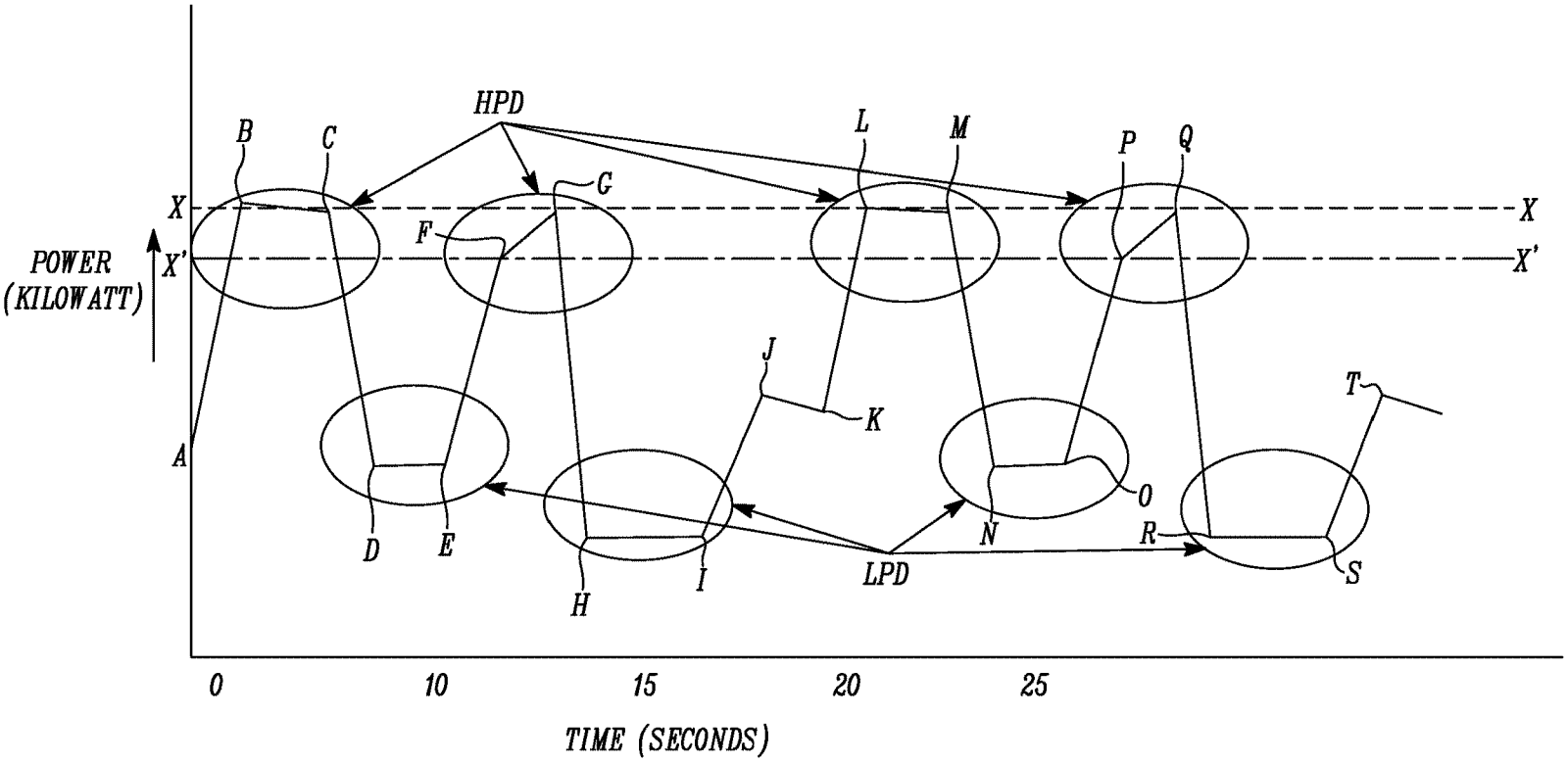
FIG. 3 is a graphical representation of power demand over a work cycle of the machine, in accordance with an embodiment of the present disclosure.

As shown in FIG. 3, a power demand curve for various work cycles of the machine 100 is depicted. The power demand values A to T represent a power demand during a segment of the repetitive work cycles of the machine 100. Every power demand value from A to T defines a combined power demand from the work tool 120 and the one or more auxiliary loads 212. The machine 100 starts operation from power demand value A. The segments BC, FG, LM, and PQ represent higher power demand values while the segments DE, HI, NO, and RS represent lower power demand values. The work tool 120 operates by digging, lifting, swinging, dumping, and returning to the digging pit. The periods where the work tool 120 operates by swinging, dumping, and returning may belong to the lower power demand LPD value segments, while the digging and lifting operations may belong to the higher power demand HPD value segments. Lines XX and X'X' represent a peak power demand value of the machine 100 and a peak power demand value of the machine 100 when the one or more auxiliary loads 212 are electrically powered in accordance with the present disclosure, respectively.

With combined reference to FIGS. 1-3, the power source 202 generates the mechanical power. The power source 202 drives the electrical generator 204 and converts the mechanical power into the electrical power. The energy storage device 206 receives and stores the electrical power from the electrical generator 204. The energy storage device 206 supplies the stored electrical power to the one or more auxiliary loads 212 as directed by the controller 210. The controller 210 determines a power demand of the work tool 120 and compares whether the determined power demand exceeds a pre-determined power threshold value. The pre-determined power threshold value may correspond to a maximum power demand from the power source 202 to support the operation of the work tool 120. The pre-determined power demand may vary based on the application requirements as well as the machine 100.

The controller 210 may regulate the supply of the electrical power to the auxiliary loads 212 to prolong the use of stored power based on a characteristic property of the auxiliary loads 212, if the determined power demand exceeds the pre-determined threshold power. In an embodiment, the characteristic property of the auxiliary load 212 may be a thermal time constant associated with at least one of the engine cooling load 214, the operator cabin cooling load 216, and the hydraulic oil cooling load 220. Here, the thermal time constant will have the meaning as known under the prior arts and as envisaged by a person of ordinary skill in the arts. In another embodiment, the thermal time constant is associated with the coolant used in the machine 100.

The controller 210 disables the electrical generator 204 from supplying the electrical power to the energy storage device 206 if the power demand exceeds the pre-determined threshold power. In other embodiments, the controller 210 may disable the electric generator 204 as well as regulate the supply of electrical power to the auxiliary load 212 based on the characteristic property of the auxiliary load 212 to prolong the use of stored electrical power.

INDUSTRIAL APPLICABILITY

Figure 4:
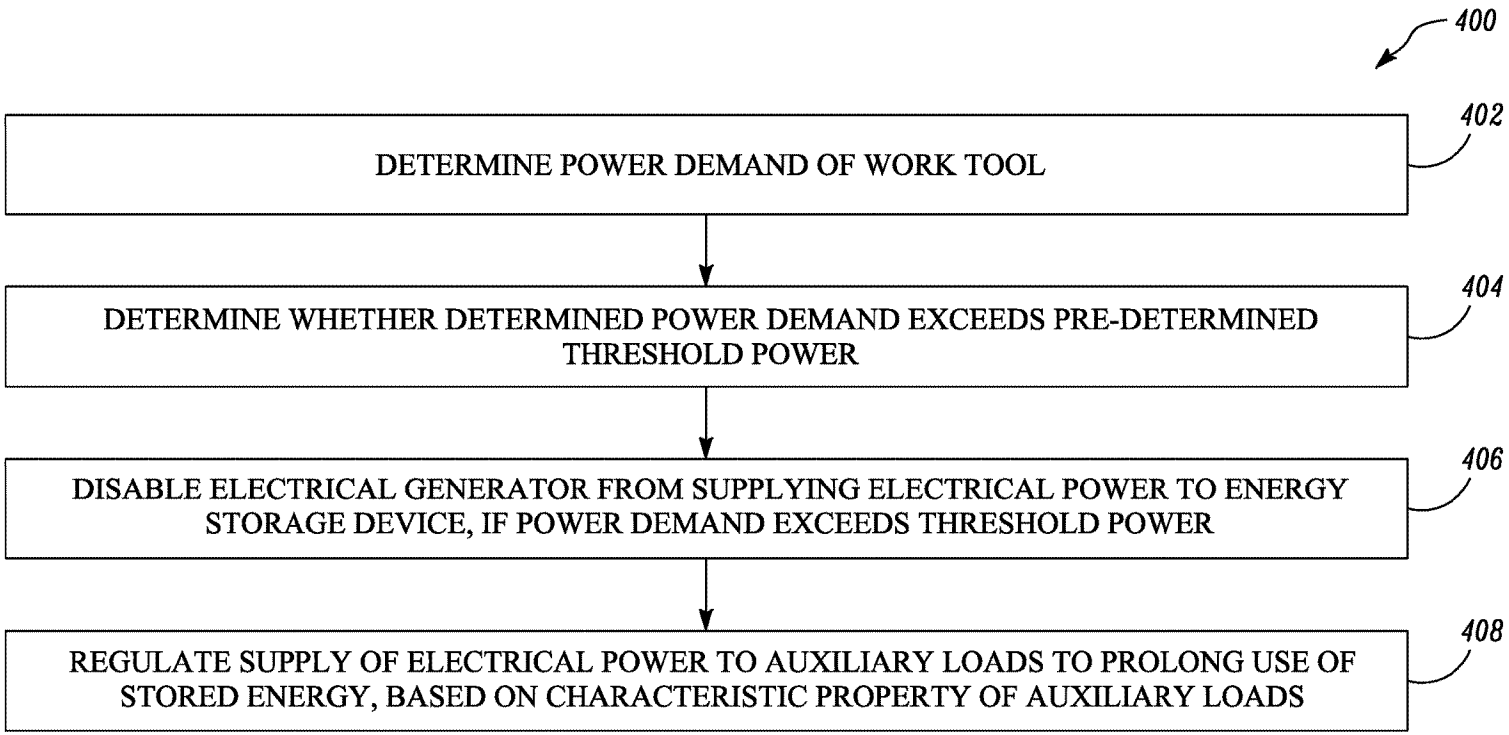
FIG. 4 is a flow chart depicting a control method for the machine, in accordance with an embodiment of the present disclosure.

The present disclosure provides a method of operating the energy storage system 200 associated with the machine 100. A method 400 for controlling the energy storage system 200 is illustrated with the help of FIG. 4. In an embodiment, the machine 100 is switched on and is operating to excavate.

The method 400 at step 402 includes determining a power demand of the work tool 120. The controller 210 may determine the power demand by analyzing stored machine data, statistical models for machine power usage etc. The power demand may be determined by any other suitable means as per the need of the present disclosure. In some embodiments, the power demand may be determined off-board and then communicated to the controller 210. The method 400 at step 404 includes comparing whether the determined power demand exceeds the pre-determined threshold power. The controller 210 may use any conventional methods to compare the determined power demand and the pre-determined threshold power. In an embodiment, the pre-determined threshold power may be stored into a memory (not shown) of the controller 210 and then retrieved as per application requirements. The method 400 at step 406 includes disabling the electrical generator 204 from supplying the electrical power to the energy storage device 206, if the power demand exceeds the pre-determined threshold power. Selectively disabling the supply of the electrical power to the energy storage device 206 enables the machine 100 to utilize all the available power of the power source 202 for digging functions only, thereby reducing the maximum possible power demand generated. This further reduces the overall engine size or capacity required to power both the work tool 120 and the one or more auxiliary loads 212, making the machine 100 run with a more constant load on the power house 202 and utilization of a power house 202 whose power output is better matched to the power demanded. Further, selective disabling also means that the energy storage device 206 is charged only during low power demand segments, thereby further improving the efficiency of the machine 100 by operating in a more fuel efficient area of a diesel power curve or any other fuel curve applicable.

The method 400 at step 408 includes regulating the supply of the electrical power to the auxiliary loads 212 based on the characteristic property of the auxiliary loads 212. The selective regulation prolongs the use of stored electrical power by using the thermal time constant as the characteristic property of the one or more auxiliary loads 212. In some embodiments where the auxiliary loads 212 constitute the engine cooling load 214, the operator cabin cooling load 216 and the hydraulic oil cooling load 220, the characteristic property may be a speed of the one or more electric fans EF. This improves the fuel efficiency as typically the speed may get reduced by only half of the original speed while energy savings may be as high as 70%. In an embodiment, other characteristic properties like volume of the coolant, specific heat, temperature of the coolant, and properties of fluid being cooled may also be used to prolong the use of stored electrical power. This further makes the machine 100 efficient as it burns less fuel for the same amount of work, further extending the overall operational life of the power source 202.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. An energy storage system associated with a machine, the machine having a work tool and one or more auxiliary loads, the energy storage system comprising:

a power source configured to generate mechanical power;

an energy storage device configured to supply electrical power to the one or more auxiliary loads;

an electrical generator operably coupled to the power source, the electrical generator configured to:

convert at least a portion of the mechanical power into electrical power; and supply the electrical power to the energy storage device; and a controller communicably coupled to the power source, the work tool, the energy storage device, and the electrical generator, wherein the controller is configured to:

determine a power demand of the work tool;

compare whether the determined power demand exceeds a pre-determined threshold power; and disable the electrical generator from supplying the electrical power to the energy storage device, if the power demand exceeds the pre-determined threshold power.

2. The energy storage system of claim 1, wherein the power demand of the work tool is an estimated power demand for a segment of the work cycle.

3. The energy storage system of claim 1, wherein the one or more auxiliary loads comprises at least one of an engine cooling load, an operator cabin cooling load, a hydraulic pilot pump load, and a hydraulic oil cooling load.

4. The energy storage system of claim 3, wherein the engine cooling load includes one or more electric fans arranged in a matrix arrangement.

5. The energy storage system of claim 3, wherein the hydraulic oil cooling load includes one or more electric fans arranged in a matrix arrangement.

6. The energy storage system of claim 1, wherein the one or more auxiliary loads comprise electrically-powered accessories of the machine.

7. The energy storage system of claim 1, wherein the pre-determined threshold power corresponds to a maximum power demand from the power source to support the operation of the work tool.

8. An energy storage system associated with a machine, the machine having a work tool and one or more auxiliary loads, the energy storage system comprising:

a power source configured to generate mechanical power;

an electrical generator operably coupled to the power source, the electrical generator configured to convert at least a portion of the mechanical power into electrical power;

an energy storage device electrically coupled to the electrical generator; the energy storage device configured to:

receive the electrical power from the electrical generator; and supply the electrical power to the one or more auxiliary loads; and a controller communicably coupled to the power source, the work tool, the electrical generator, and the energy storage device, wherein the controller is configured to:

determine a power demand of the work tool;

determine whether the determined power demand exceeds a pre-determined threshold power;

disable the electrical generator from supplying the electrical power to the energy storage device, if the determined power demand exceeds the pre-determined threshold power; and regulate the supply of the electrical power to the one or more auxiliary loads to prolong the use of stored energy based on a characteristic property of the one or more auxiliary loads, if the determined power demand exceeds the pre-determined threshold power.

9. The energy storage system of claim 8, wherein the power demand of the work tool is an estimated power demand for a segment of the work cycle.

10. The energy storage system of claim 8, wherein the one or more auxiliary loads comprises at least one of an engine cooling load, an operator cabin cooling load, a hydraulic pilot pump load, and a hydraulic oil cooling load.

11. The energy storage system of claim 10, wherein the engine cooling load includes one or more electric fans arranged in a matrix arrangement.

12. The energy storage system of claim 10, wherein the hydraulic oil cooling load includes one or more electric fans arranged in a matrix arrangement.

13. The energy storage system of claim 10, wherein the characteristic property of the one or more auxiliary loads includes a thermal time constant associated with at least one of the engine cooling load, the operator cabin cooling load, and the hydraulic oil cooling load.

14. The energy storage system of claim 8, wherein the one or more auxiliary loads comprise electrically-powered accessories of the machine.

15. The energy storage system of claim 8, wherein the pre-determined threshold power corresponds to a maximum power demand from the power source to support the operation of the work tool.

16. An energy storage system associated with a machine, the machine having a work tool and one or more auxiliary loads, the energy storage system comprising:

a power source configured to generate mechanical power;

an energy storage device configured to supply electrical power to the one or more auxiliary loads;

an electrical generator operably coupled to the power source, the electrical generator configured to:

convert at least a portion of the mechanical power into electrical power; and supply the electrical power to the energy storage device; and a controller communicably coupled to the power source, the work tool, the energy storage device, and the electrical generator, wherein the controller is configured to:

determine a power demand of the work tool;

determine whether the determined power demand exceeds a pre-determined threshold power;

disable the electrical generator from supplying the electrical power to the energy storage device, if the power demand exceeds the pre-determined threshold power; and regulate the supply of the electrical power to the one or more auxiliary loads to prolong the use of stored energy, based on a characteristic property of the one or more auxiliary loads, wherein the one or more auxiliary loads include at least one of an engine cooling load, an operator cabin cooling load, a hydraulic pilot pump load, and a hydraulic oil cooling load.

17. The energy storage system of claim 16, wherein the engine cooling load includes one or more electric fans arranged in a matrix arrangement.

18. The energy storage system of claim 16, wherein the hydraulic oil cooling load includes one or more electric fans arranged in a matrix arrangement.

19. The energy storage system of claim 16, wherein the pre-determined threshold power corresponds to a maximum possible power demand of the work tool.

20. The energy storage system of claim 16, wherein at least one of the engine cooling load or the hydraulic oil cooling load includes one or more electric fans arranged in a matrix arrangement.

* * * * *